US005669963A

United States Patent [19]

Horton et al.

[11] Patent Number: 5,669,963

[45] Date of Patent: Sep. 23, 1997

[54] ELECTRONIC AIR CLEANER

[75] Inventors: Woodson Horton, Corryton; Mark D. Lane, Powell, both of Tenn.; Ronald R. Smith; Timothy R. Mitchell, both of Indianapolis, Ind.

[73] Assignee: Carrier Corporation, Syracuse, N.Y.

[21] Appl. No.: 578,353

[22] Filed: Dec. 26, 1995

[51] Int. Cl.[6] ..... B03C 3/12

[52] U.S. Cl. ..... 96/77; 96/83; 96/84; 96/86; 96/87

[58] Field of Search ..... 96/80–88, 57, 96/58, 96, 97, 76, 77

[56] References Cited

U.S. PATENT DOCUMENTS

| | | | |
|---|---|---|---|
| 3,143,403 | 8/1964 | Swensen | 96/86 |
| 3,438,180 | 4/1969 | Klouda | 96/58 |
| 3,626,668 | 12/1971 | Cardiff | 96/81 X |
| 3,654,747 | 4/1972 | Remick | 96/81 X |
| 3,849,090 | 11/1974 | Remick | 96/86 |
| 4,089,661 | 5/1978 | Milum | 96/76 |
| 5,071,455 | 12/1991 | Abedi-Asi | 96/86 X |
| 5,137,552 | 8/1992 | Sasaki | 96/86 X |
| 5,290,343 | 3/1994 | Morita et al. | 96/83 X |
| 5,456,741 | 10/1995 | Takahara et al. | 96/57 X |

*Primary Examiner*—Richard L. Chiesa

[57] ABSTRACT

A simplified electronic air cleaner cell structure having a pair of spaced plastic side support members which provide the entire support for the ionizer elements and collector elements mounted therebetween. Portions of one of the side members are made of an electrically conductive material, and the high voltage ionizer and collector elements are mounted thereto, with electrical interconnections being made between those conductive portions and a power source.

11 Claims, 10 Drawing Sheets

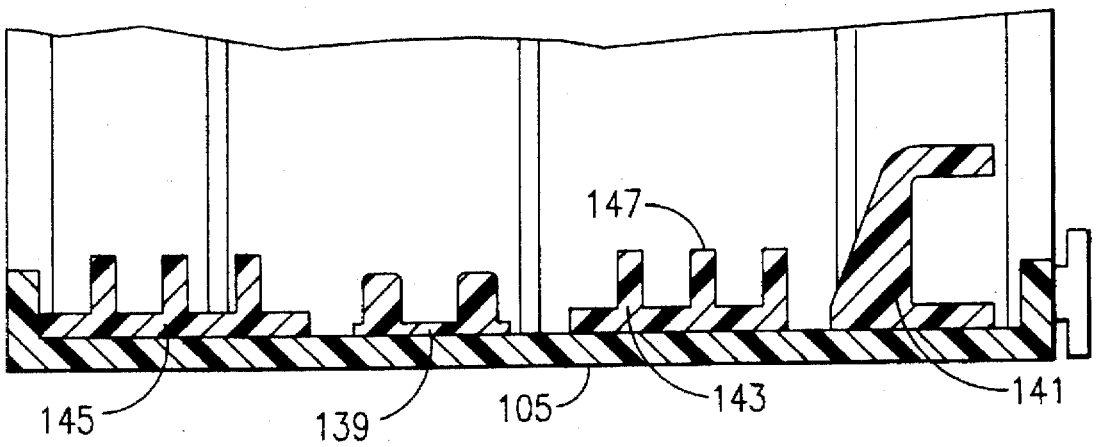
FIG.11
FIG.12
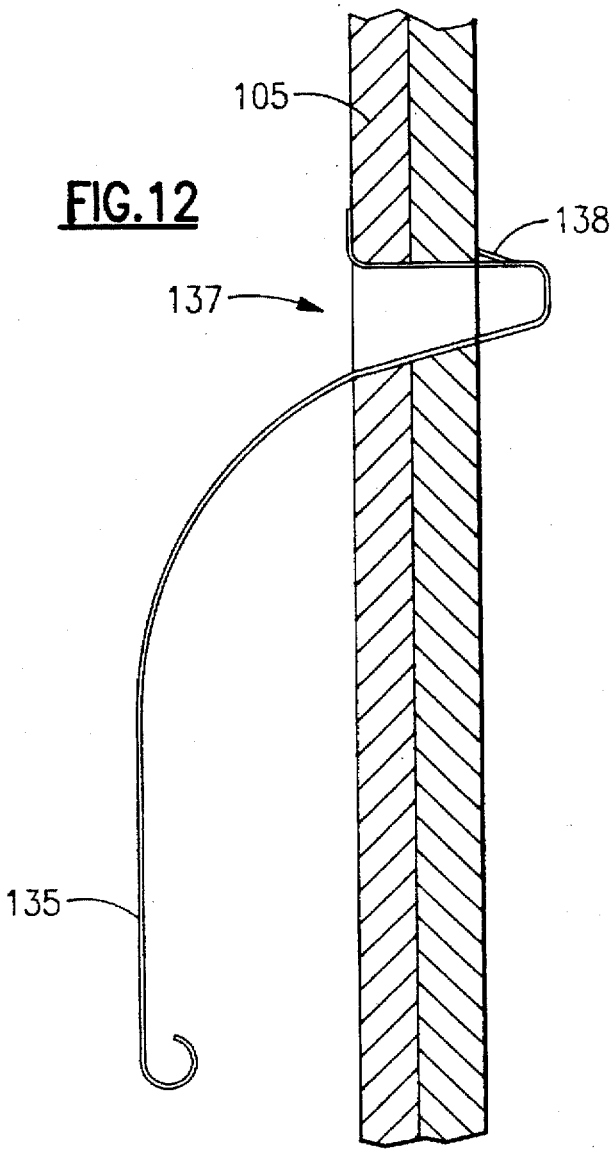
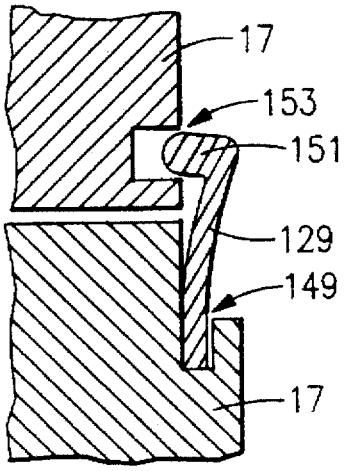
FIG.13

ELECTRONIC AIR CLEANER

BACKGROUND OF THE INVENTION

This invention relates generally to electrostatic air cleaning devices and, more particularly, to an improved cell structure and method of making same.

A typical electrostatic air cleaner cell includes an ionizer section and a collector section, both of which include discrete high voltage elements interconnected between grounded plates. That is, the ionizer has positive wires and negative strips alternately connected in parallel relationship, between the grounded plates. The collector section in turn, has installed between its grounded plates, alternate high and low voltage plates arranged in parallel relationship. This combination of high and low voltage plates and wires are typically secured and isolated from one another by a variety of insulators, tubes, spacers, etc., such as is shown in U.S. Pat. No. 4,089,661 issued on May 16, 1978.

Such a prior art design requires that the charging rods be forced through the tubes in order to expand the tubes into tight engagement within the holes of the plates. Such a process and design approach is undesirable for several reasons. First, the tubes, plates and rods are relatively heavy and expensive to provide. Secondly, the assembly process which includes the requirement to wash off filings that result from the tube expansion step is rather complicated and expensive to accomplish. Finally, the provision for tubes passing through the plates necessarily takes away from the effective surface area of the plates and therefore reduces performance.

It is therefore an object of the present invention to provide an improved electrostatic air cleaner cell structure and method of manufacture.

Another object of the present invention is the provision for reducing the weight of, and the cost to manufacture, an electrostatic air cleaner cell.

Yet another object of the present invention is the provision for simplifying the structure of an electrostatic air cleaner cell.

Still another object of the present invention is the provision for an electrostatic air cleaner cell which is economical to manufacture and effective and efficient in use.

These objects and other features and advantages become readily apparent upon reference to the following descriptions when taken in conjunction with the appended drawings.

SUMMARY OF THE INVENTION

Briefly, in accordance with one aspect of the invention, a pair of plastic, non-conductive, side members are provided to support the collector plates and ionizer wires therebetween, with high voltage electrical connections being made to the ionizer wires and to alternate collector plates, by way of the side members. In this way, the structure of the cell is simplified, the cost of the materials reduced, and the performance is increased because of the use of the complete surface of the collector plates.

In accordance with another aspect of the invention, the electrical interconnection to the collector plates is made by way of electrically conductive strips that form a part of the side members, with the strips then being mechanically engaged with electrical contact means.

By yet another aspect of the invention, the integration of the conductive strips with the plastic side members is made by a molding process wherein a conductive material is inserted into the mold with the non-conductive material, such that a single molded part results, with the conductive material being integral with the non-conductive material on either side thereof. Electrical connection is then made to the collector plates by fitting the plates between extended fingers of the conductive material on the inner side thereof, and by attaching electrical contact elements to the conductive material on the outer side thereof.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

FIG. 11 is a partial sectional view of one of the side walls of the cell as seen along lines 11—11 in FIG. 9.

FIG. 12 is a partial sectional view of the side wall with a clip installed therein.

FIG. 13 is a partial sectional view of an installed interconnect clip in accordance with the present invention.

DESCRIPTION OF THE PREFERRED EMBODIMENT

Figure 1:
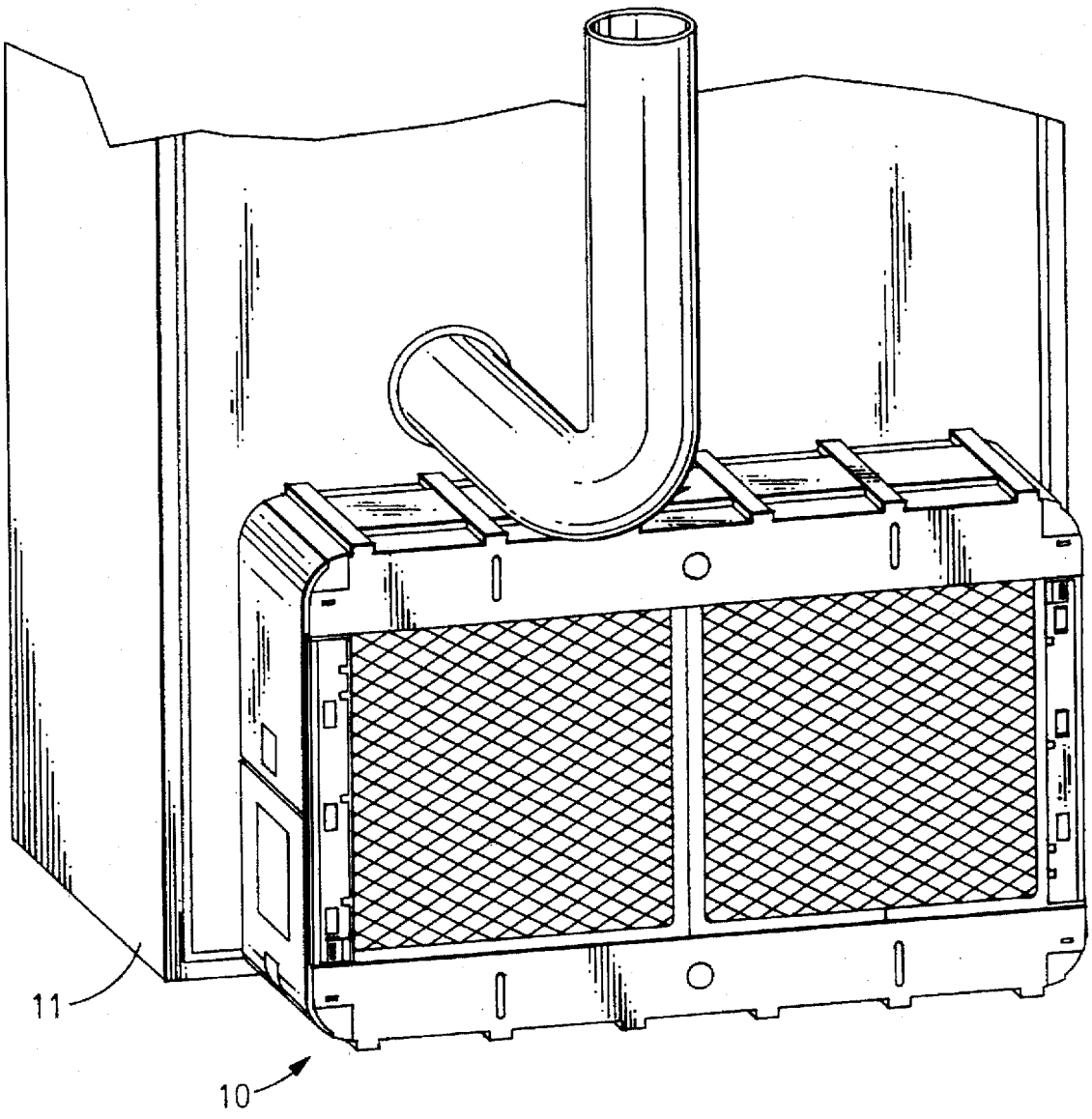
FIG. 1 is a perspective view of an installed electronic air cleaner in accordance with the present invention.

Referring now to FIG. 1, the air cleaner assembly of the present invention is shown generally at 10 as applied to the side of an upflow furnace 11. In such an installation, the circulation air blower in the furnace 11 causes air to flow from the room, back through the return air duct (not shown), through electronic air cleaner 10 and into the furnace 11, where it is either heated by the furnace or cooled by an air conditioner evaporator coil mounted at the top of the furnace (not shown).

As alternatives to the side mounted installation as described above, the electronic air cleaner 10 may be mounted below the furnace (for an upflow furnace), or above the furnace (for a downflow furnace). In any case, the air cleaner is installed between the return air duct and the air circulation fan. The particular manner in which the air cleaner assembly 10 is installed within the system is not important for purposes of describing the present invention. However, it is important to recognize that the design of the air cleaner assembly 10 is adaptable to various installation requirements, such that the size of the air cleaner assembly can match the capacity requirements of the particular furnace installation without the use of special adaptation or transitional structures.

Figure 2:
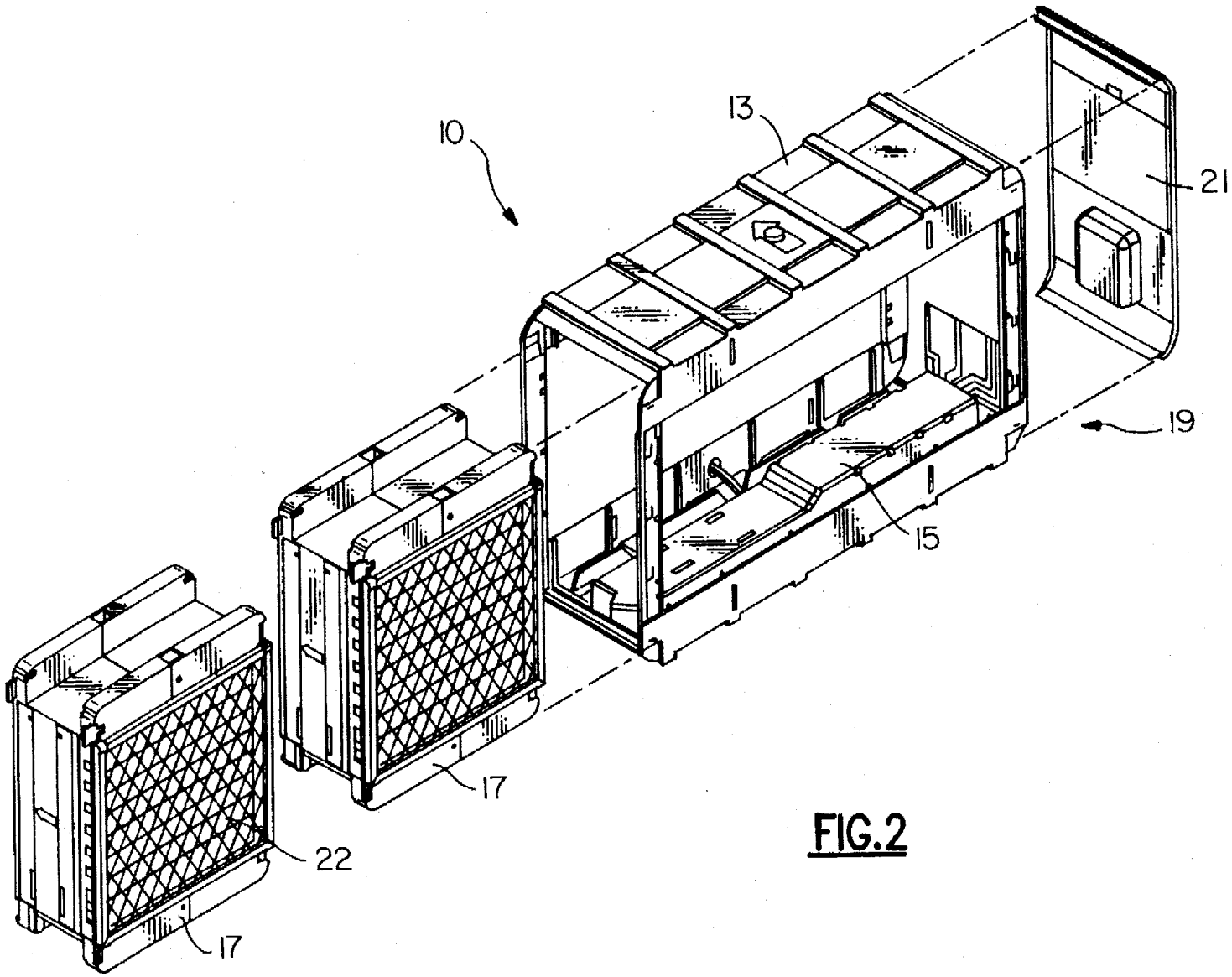
FIG. 2 is an expanded view of portions thereof.

As will be seen in FIG. 2, the air cleaner assembly 10 comprises a containment assembly or casing 13, into which there is installed a power supply tray 15 at the bottom thereof, and a pair of identical air cleaner cells 17 placed in lateral side-by-side relationship so as to fill the opening 19 through which the air to be cleaned is longitudinally drawn. A door 21 is installed on each lateral end of the casing 13 to complete, and close, the structure. The power supply tray 15 is semi-permanently installed (i.e. it is only removed for replacement purposes), whereas the cells 17 are periodically removed from the casing 13 for purposes of cleaning. A mechanical screen filter 22 is preferably installed on the upstream side of each cell 17 as shown.

Figure 3C:
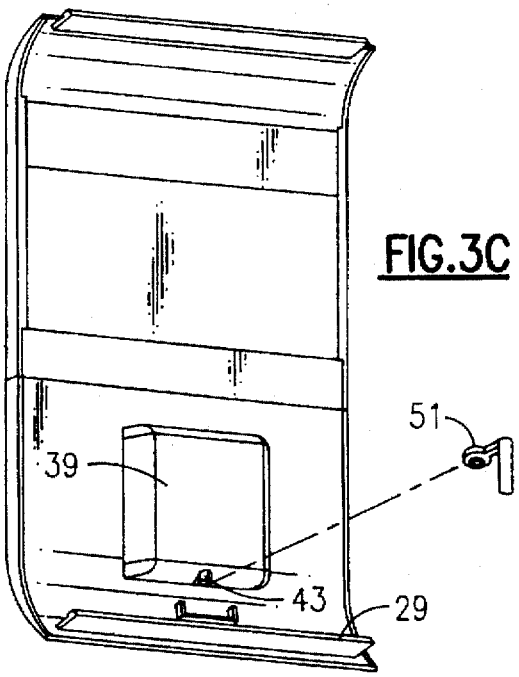
FIGS. 3A, 3B and 3C are expanded perspective views of a door portion thereof.
Figure 3A:
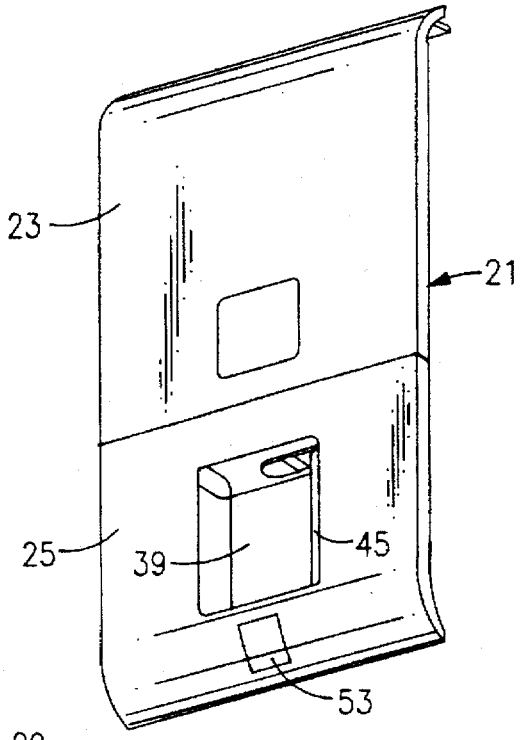
Figure 3B:
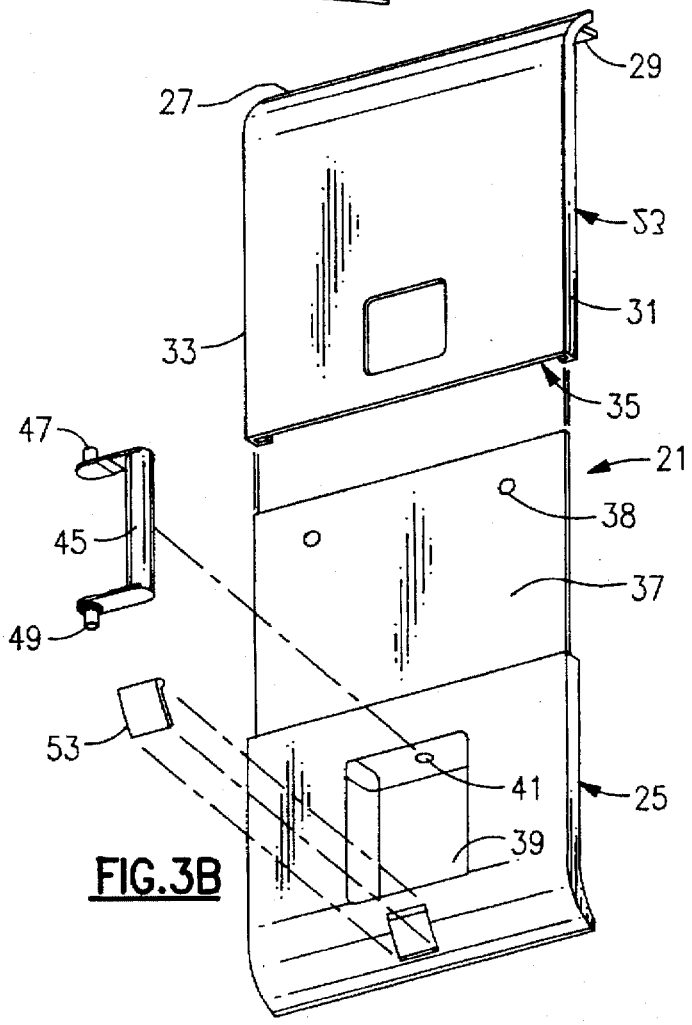

Referring now to FIGS. 3A 3B and 3C, a door 21 is shown to include upper section 23 and lower section 25. The upper section 23 has a curved transverse end that 27 matches a similar curve in the casing 13, and has on its inner side a locking flange 29 that allows it to be locked into place by engagement with a similar flange in the casing 13. A pair of track sidewalls 31 and 33 define a track 35 for slideably receiving, in a telescopic manner, a tongue portion 37 of the lower section 25. Each of the doors 21 can therefore be adjusted in length to accommodate varying sizes of casings as will be described more fully hereinafter. Dimples (not shown) are provided in one part to engage with indents 38 of the other part to lock the two in their extended positions. In one of the doors, the door lower section 25 includes a handle indent housing 39 with openings 41 and 43 in the bottom and top thereof, respectively. A handle 45 is provided with top pivot post 47 and bottom pivot post 49 adapted for being spring loaded into the top and bottom openings, 41 and 43, respectively. Secured to the top post 49 is a crank 51, which interfaces with a switch, to be described hereinalter, for shutting down the power when the door is opened.

In operation, when the crank handle 45 is in its secured position as shown in FIG. 3A, the crank 51 will be in such a position as to hold the switch in a closed position so as to activate the system (i.e. to allow the power to be applied thereto). However, when the handle 45 is pulled out of the indent housing 39, the crank 51 is caused to rotate to thereby release the switch to inactivate the power.

Figure 4:
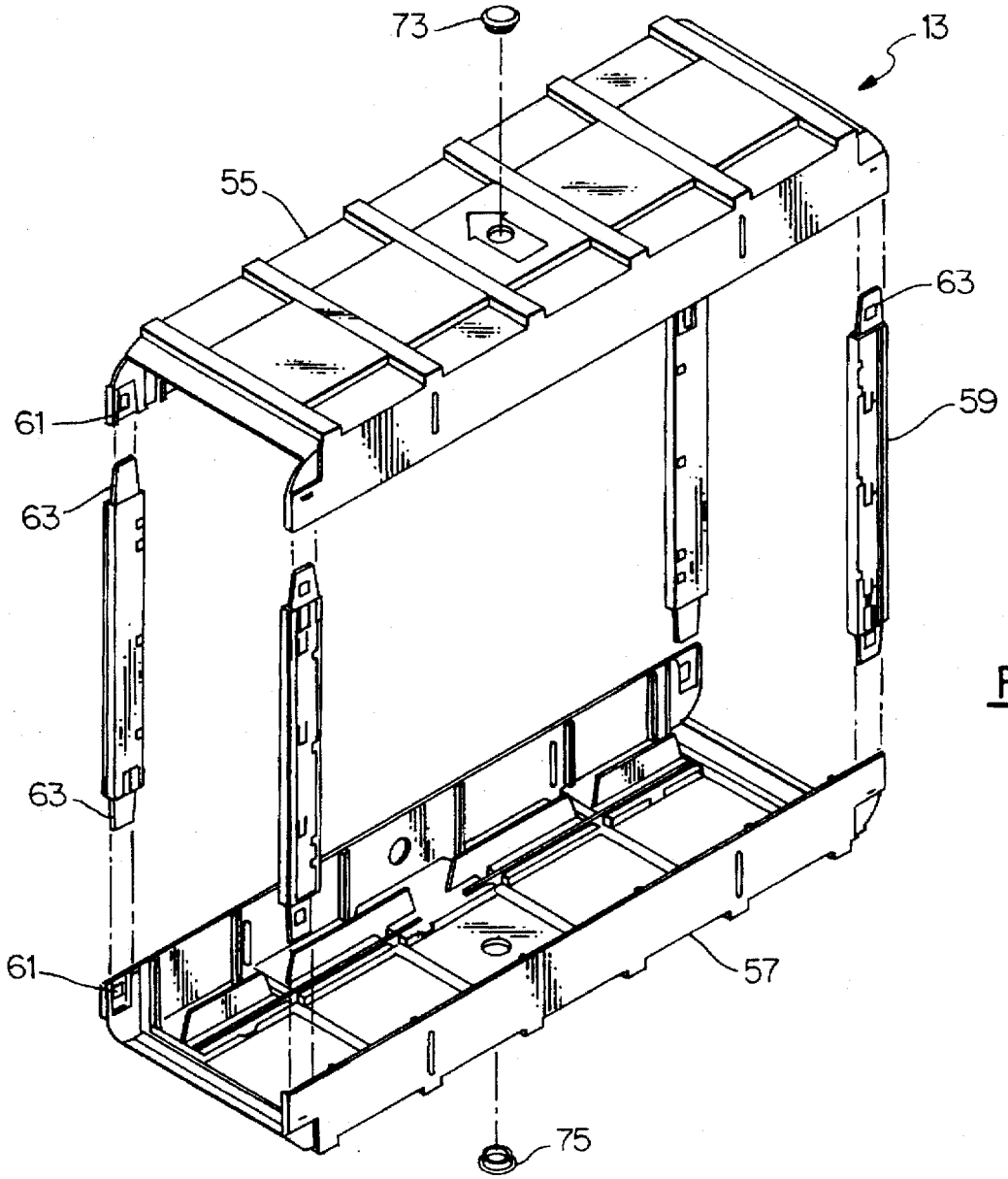
FIG. 4 is an expanded view of the casing portion thereof.
Figure 5:
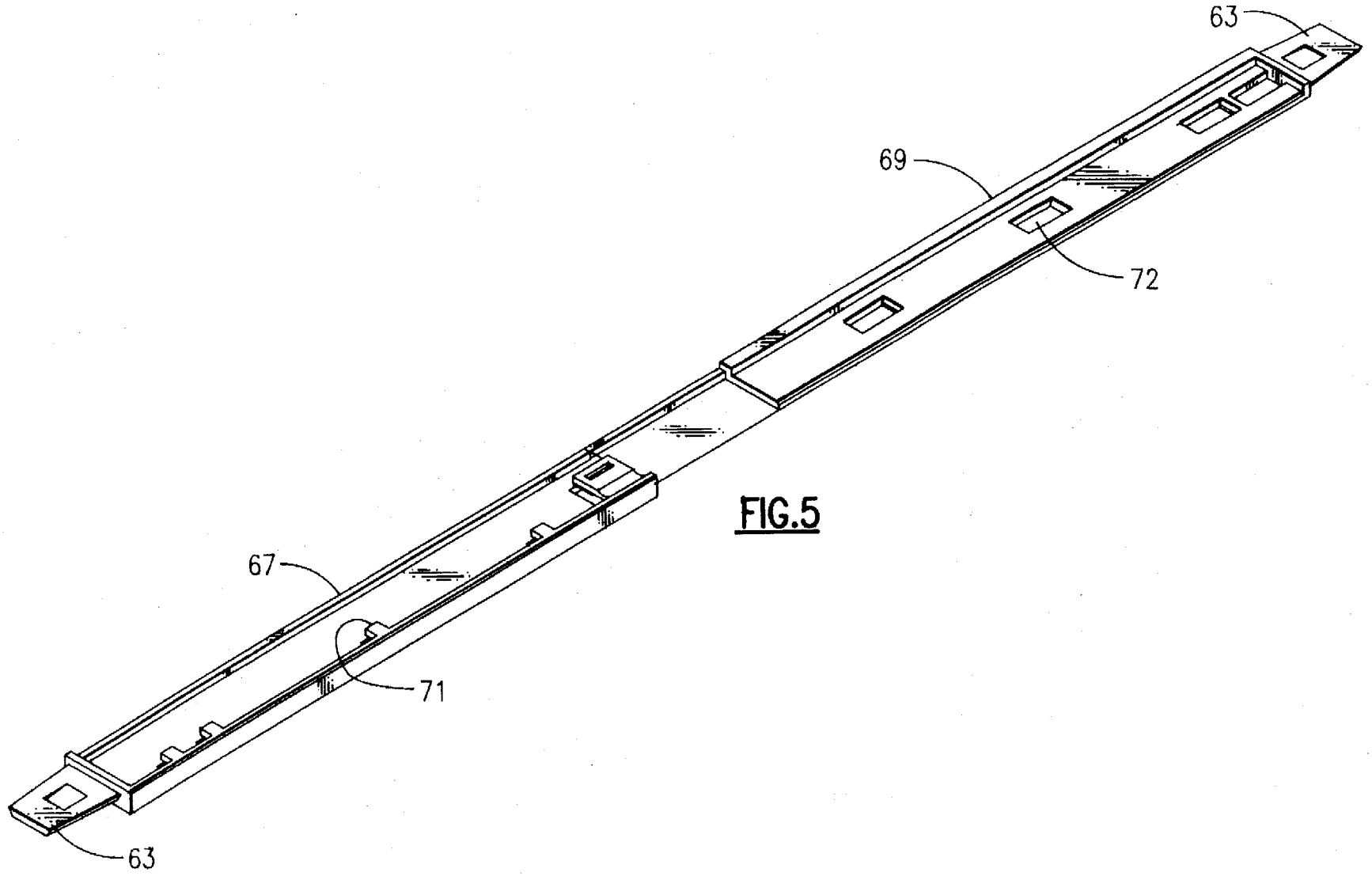
FIG. 5 is a perspective view of an expandable leg portion thereof.

The casing 13 as shown in FIG. 4 includes an upper wall 55, lower wall 57, and four identical expandable support members or legs 59. In each of the four corners of the upper 55 and lower wall 57, there are provided slots 61 for receiving the tongues 63 of the expandable legs 59. As will be seen in FIG. 5, each of the expandable legs comprises inner 67 and outer 69 members telescopically interconnected so as to permit the transverse height of the casing 13 to be adjusted according to the particular size of the cells that are to be installed. When adjusted to the proper length, the tube 71 in one part engages with holes 72 in the other part to lock the two in their relative positions, so as to fix their length and provide a rigid structure into which the cells can be installed. For example, although the width of the casing 13 is fixed, the heights of the cells are changed to accommodate various sizes of cells, such as cells capable of 1400 CFM and 2000 CFM, for example. The same casing 13 can be used for each of these sizes, simply by expanding the legs 59 to the desired length.

The upper 55 and lower 57 walls have openings with plugs 73 and 75, respectively. These can be removed to accommodate the entry of electrical leads into the casing. For example, the bottom plug 75 may be removed for bringing in the leads to the power source, while the top plug 73 remains in place. The casing 13 components are preferably made of a moldable plastic having high strength characteristics, such as LEXAN™.

Figure 6:
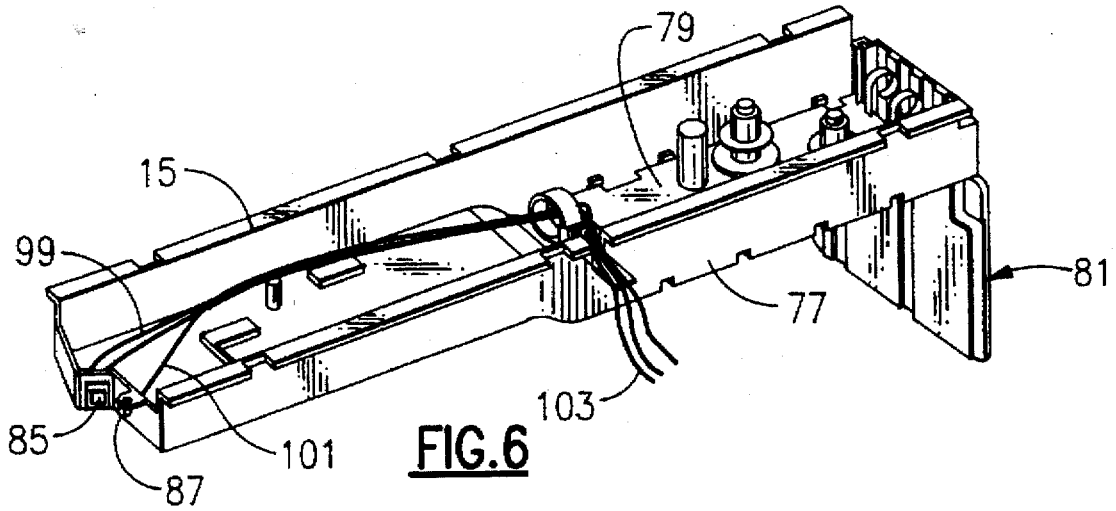
FIG. 6 is a perspective view of a power supply tray portion thereof.
Figure 7:
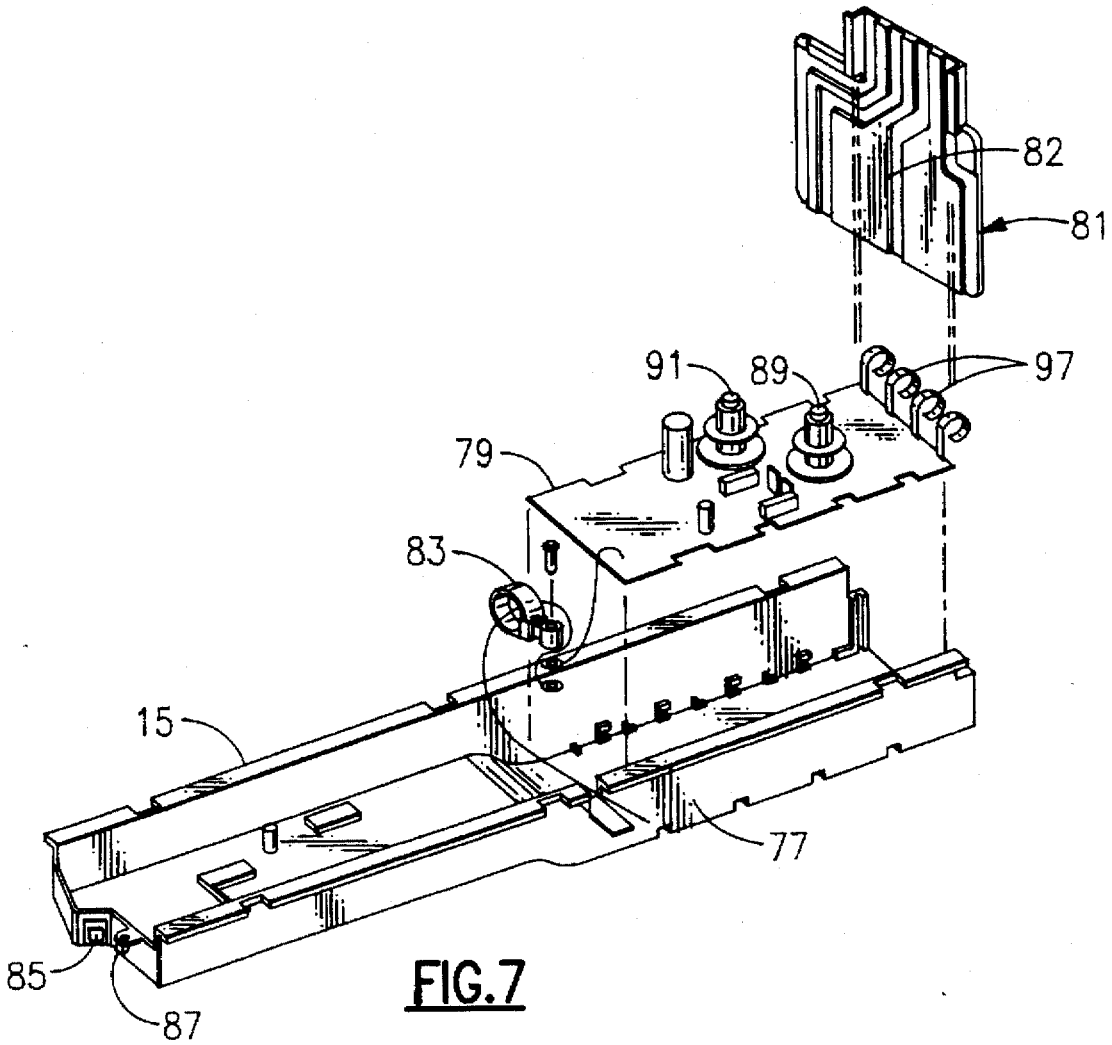
FIG. 7 is an expanded view thereof.

Referring now to FIGS. 6 and 7, the power supply tray 15 includes a base 77 into which a circuit board 79 and a back wall 81 are installed. Trace circuits 82 are attached to the back wall 81. A wire tie 83 is provided near the center thereof, and a switch 85 and an indicator LED 87 are provided at one end thereof.

The circuit board 79 includes transformer 91, and a plurality of stainless steel circuit contacts 97. A pair of leads 99 provide for electrical interconnection between the switch 85 and the circuit board 79. Leads 101 electrically interconnect LED 87 to the circuit board 79. And leads 103 electrically interconnect the circuit board 79 to a 115 V source.

In operation, power flows into the leads 103, to the switch 85. If the switch 85 is open, as would occur when the door handle 45 is pulled out, no power will flow past the switch 85. If it is closed by the crank 51 linked to the door handle 45, then 115 V power flows to the circuit board 79 where it is transformed to useful voltage levels to be provided to the circuit contacts 97. Thus, one of the contacts 97 will receive voltage of 8500 volts, one at 7500 volts and two at ground voltage level. By direct engagement with the back wall 81, the contacts 97 establish their respective voltage levels on the trace circuits 82 in the back wall 81. They, in turn, are engaged by contacts in the cells, in a manner to be described, to establish the appropriate voltage levels in the appropriate parts of the cells.

Figure 8:
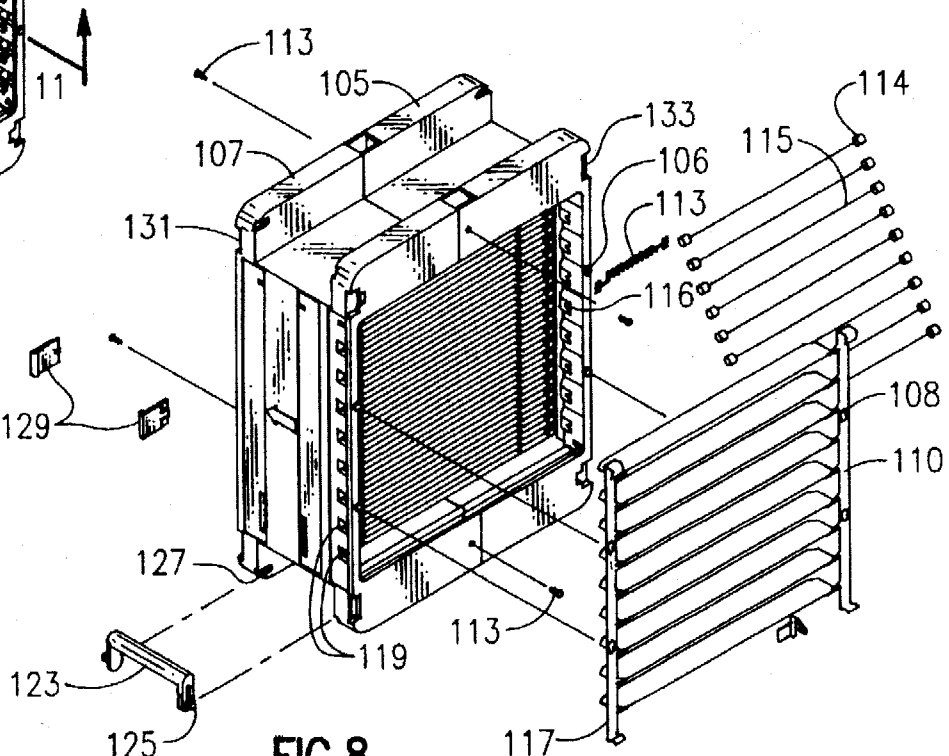
FIGS. 8 and 9 are expanded views of the air cleaner cell of the present invention.
Figure 9:
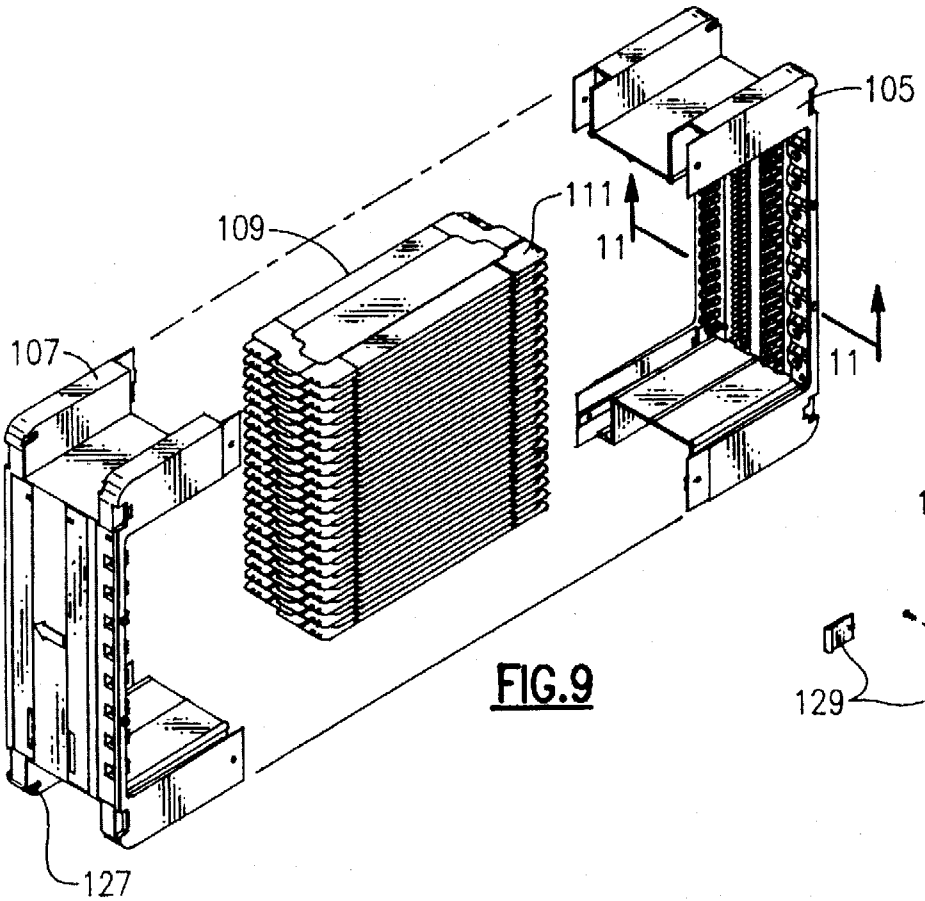
Figure 10:
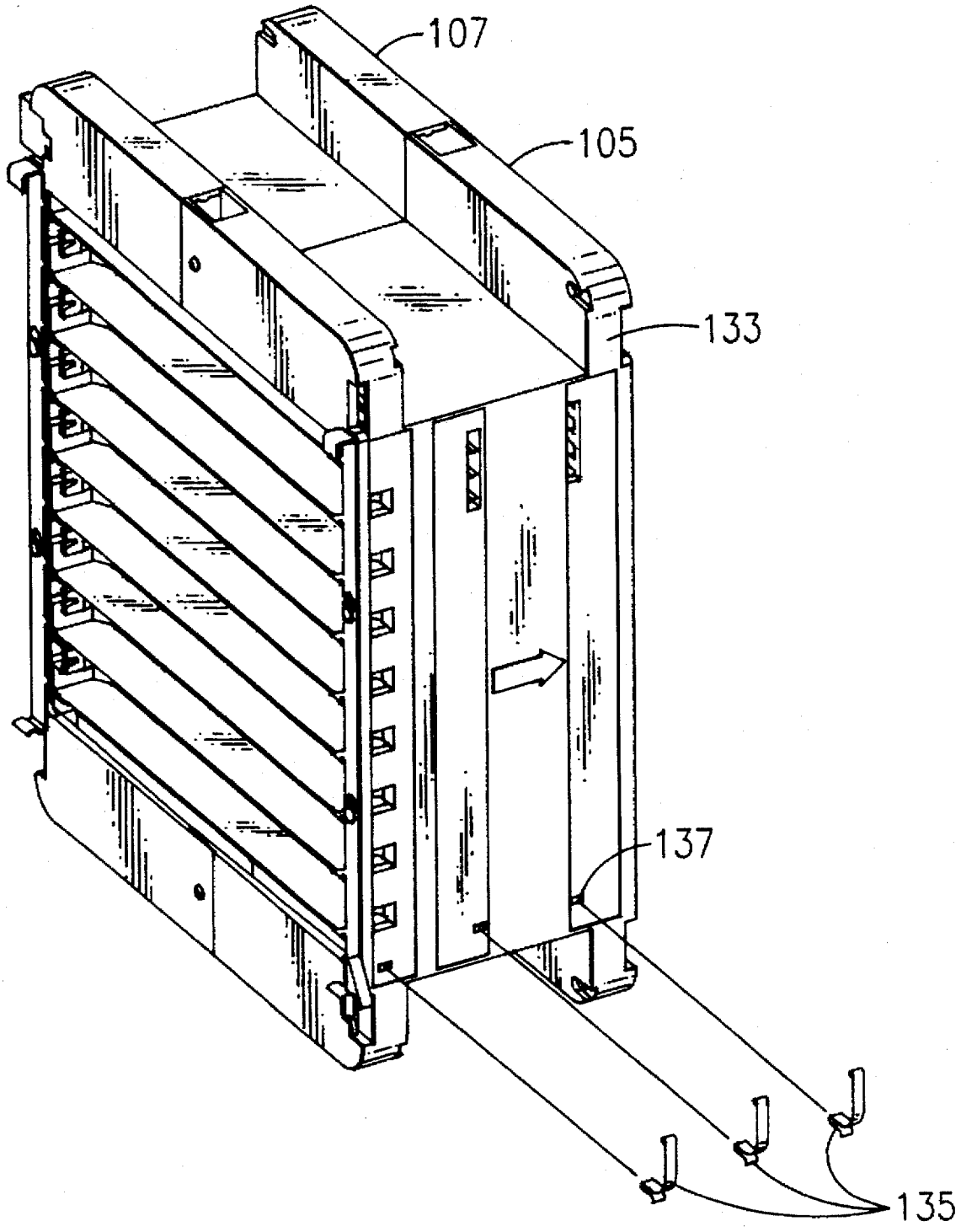
FIG. 10 is a rear perspective thereof.

The structure of a cell 17 as shown in FIGS. 8, 9 and 10 includes a pair of U-shaped frame members 105 and 107 with a plurality of transversely spaced aluminum collector plates 109 disposed therebetween. The collector plates 109 have tabs 111 on either side thereof which fit into grooves in the respective frame members 105 and 107. The frame members 105 and 107 have appropriate structure on the ends thereof so as to inter-mesh to form a rigid structure with only four fasteners 113 securing them together.

The frame members 105 and 107 are made of a suitable moldable plastic such as a thermoset polyester material which is commercially available from Rostone Corp. under the name ROSTITE™. This material is generally non-conductive and therefore suitable for an insulated support structure for the high voltage collector plates 109. However, portions of the frame member 105 contain conductive material for purposes of providing electrical interconnection to the aluminum collector plates 109 in a manner to be described hereinafter.

Longitudinally spaced from the collector section on the upstream side thereof, is the ionizer section which includes the plurality of ionizer wires 115 and ground plates 117, all of which are mounted between the two frames members 105 and 107. The aluminum ground plates are attached to the frame members 105 and 107 by way of posts 106 on the frame members that pass through openings 108 in the supporting legs 110 of the ground plate 117. The ground plates are therefore at ground level voltage. The ionizer wires 115, on the other hand, have, on their ends, anchor lugs 114 that are mounted in grooves 116 of conductive portions of the frame members 105 and 106. In this way, they are interconnected to the high voltage source by the way in which they are mounted in the frame member 105 as will be more fully described hereinafter.

As will be seen in FIG. 8, a handle 123 is mounted by way of end pivots 125 in mounting holes 127 on either side of the frame member 107. This handle provides a convenient means for reaching in and grasping the handle to slide the cell 17 out from the casing, for purposes of cleaning and the like. At the top end of the frame member 107, on either side thereof is a cell clip 129 that is secured in a front slot 131 in such a manner as to extend laterally beyond the edge of the frame member 107 so as to engage a rear slot 133 of an adjacent cell. In this manner the two cells can be locked together for purposes of removal from the casing. That is, as the first cell is pulled out by way of the handle 123, the clips in its rear slot 133 grasp the cell which is laterally behind it and cause it to be pulled out with the first cell. The specific structure of the cell dips 129 will be described hereinafter.

As will be seen in FIG. 10, the rear side of a cell includes three stainless steel clips 135 which fit into openings 137 of the outer side of frame member 105 as shown and are held in place by barbs. These clips provide the electrical interconnection between the trace circuits in the back wall 81 and the conductive portions of the frame member 105 for purposes of providing the proper voltage levels to the collector plates and ionizer wires as will be more fully described hereinafter.

As mentioned hereinbefore, the frame member 105 must serve as both a plastic non-conductive support for alternate collector plates at ground voltage level and for the aluminum ground plates, as well as serving as a support for the alternate high voltage-charged aluminum collector plates and the ionizer wires. This is accomplished with the use of a hybrid molded material as shown in FIG. 11. The non-conductive portion 139 of the frame member 105 is composed of a plastic material which exhibits good insulating properties, such as the thermoset Polyester material described above. The conductive portions 141, 143, and 145 are comprised of the same moldable plastic material, but with additives which cause the material to exhibit good electrical conductive characteristics. An example of a material which has been used for this purpose is a conductive carbon filler that is commercially available from Degussa as a super conductive carbon black identified as PRINTEX-XE2. The conductive material is loaded into the appropriate areas of the die, in alternate arrangements, as shown. The non-conductive material is then placed on top of the conductive material so that the molded part has conductive strips encapsulated by non-conductive material. The dye is then compressed and heated to cure the materials as shown. As will be seen, the conductive portions 143 and 145 have three rows each of teeth 147 arranged in a staggered relationship such that the center row is offset from the side rows. This arrangement permits the tabs 111 of the collector plates 109 to be inserted therebetween in a friction fit relationship. As will be seen in FIG. 9, the tabs 111 are so arranged in alternate relationship, so that alternate conductive plates will be engaged with the conductive material 143 and 145, respectively, such that when the power is connected to the conductive materials 143 and 145, the conductor plates 109 will be alternately at high and low voltage conditions. For example, the first plate would have a tab which would be in contact with the conductive portion 145, but not in contact with the conductive portion 143. The second plate has a tab which is in electrical contact with only the conductive material 143, and not the conductive portion 145, and so on.

The third conductive portion 141 is provided for electrical connection to the ionizer wires 115. This interconnection is made by way of the lugs 114 and grooves 116 as described above. The various voltage levels are thus established as follows. The ground plates are set at ground voltage by a clip (not shown) which electrically interconnects one of the ground level trace circuits 82 directly to the support legs 110 of the aluminum ground plates 117. The ionizer wires are set at 8500 V by a clip 135 which engages the strip 141. The high voltage collector plates are set at 7500 V by a clip 135 which engages the strip 143. And the low voltage collector plates are set at ground by a clip 135 which engages the strip 145.

Referring now to FIG. 12, a clip 135 is shown in its installed position in an opening 137 in the frame member 105. Here, the conductive material is shown on the inner side (right side), with the non-conductive material being on the outer (left side). In fact, the conductive material may permeate only a portion of the structure as shown or the entire portion from the inside to the outside. It is only necessary that the clip 135 make electrical contact with the conductive portion thereof. This is accomplished by engagement of the clip in the opening 137, and also on the inner side by a barb 138 which also acts to hold it in place. The curved outer end of the clip 135 then makes contact with the appropriate trace circuit 82 of the back wall.

Figure 14:
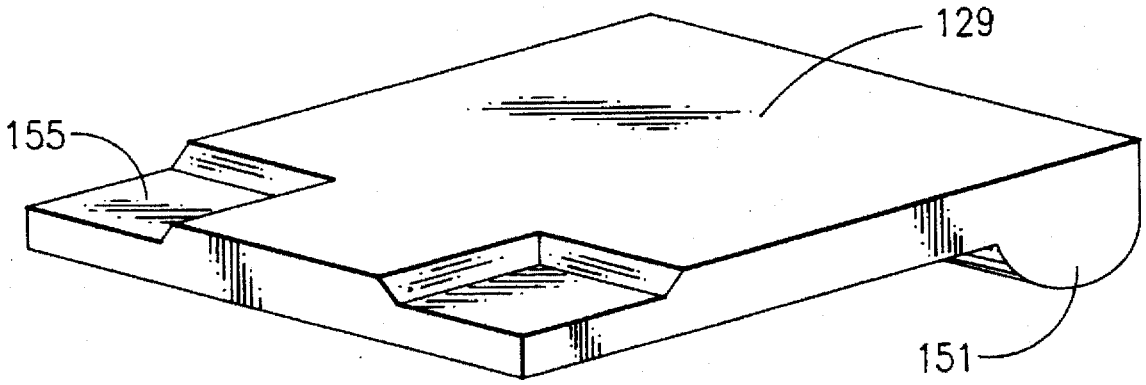
FIG. 14 is a perspective view of the interconnect clip.

Referring now to FIGS. 13 and 14, the cell clip 129 is shown with its one straight end installed in a slot 149 of a first, or front cell 17. The clip then extends laterally beyond the edge of the lateral side of the front cell 17, and beyond the lateral edge of the rear cell 17 such that its knob 151 then snaps into an opening 153 in the rear cell 17, as shown. Thus, the cell clip 129 is tightly installed in the slot 149 and is flexible to flex outwardly when its knob 151 reaches the edge of the rear cell. The flex bias of the clip then causes the knob 151 to move back into the opening 153 to lock the two cells together. A pair of relieved surfaces 155 are provided on one side of the clip 129 for purposes of locking it in place in its slot 149.

What is claimed is:

1. An improved electrostatic air cleaner cell having an ionizer section which includes a plurality of ionizer elements to be electrically charged for ionizing particles contained in the air flowing therethrough, and having axially spaced from the ionizer section, a collector section which includes a plurality of collector elements to be electrically charged for attracting or repelling the ionized particles, wherein the improvement comprises:

a pair of laterally spaced support elements having the ionizer and collector elements supportably interconnected therebetween, said support elements comprising a non-conductive material so as to electrically isolate the supported ionizer and collector elements from other structural elements of the cells;

ionizer charging means for electronically interconnecting a portion of the ionizer elements to a source of high voltage electricity; and collector charging means for electrically interconnecting alternate collector elements to a source of high voltage electricity.

2. An improved electrostatic air cleaner cell as set forth in claim 1 wherein said support elements are made of molded plastic.

3. An improved electrostatic air cleaner cell as set forth in claim 2 wherein said support elements are comprised of a moldable plastic material.

4. An improved electrostatic air cleaner cell as set forth in claim 1 wherein said support elements include an electrical conductive portion that is interconnected to alternate collector elements.

5. An improved electrostatic air cleaner cell as set forth in claim 4 wherein said support elements are made of molded plastic with electrical conducting portions and electrical non-conducting portions being molded together.

6. An improved electrostatic air cleaner cell as set forth in claim 5 wherein said electrical conducting portion is partially comprised of a carbon filler.

7. An improved electrostatic air cleaner cell as set forth in claim 3 wherein said plastic material is a thermoset polyester material.

8. An improved electrostatic air cleaner cell having a plurality of alternately disposed positively charged and neutrally grounded ionizer elements and a plurality of alternately disposed positively charged and neutrally grounded collector elements, wherein the improvement comprises:

a pair of laterally spaced side members being interconnected at their ends by laterally extending top and bottom end members to form a rigid support structure;

each of said side members having a non-conductive portion providing structural support for the ionizer and collector elements;

at least one of said side members having a plurality of conductive portions to which the positively charged ionizer elements and collector elements are attached at their one ends with the other of said side members having a portion that is either conductive or non-conductive and to which the positively charged ionizer elements and collector elements are attached at their other ends, thereby providing the sole support therefor; and means for electrically interconnecting a high voltage source to said conductive portions.

9. An improved electrostatic air cleaner cell as set forth in claim 8 wherein said side members are comprised of a moldable plastic material.

10. An improved electrostatic air cleaner cell as set forth in claim 9 wherein said material is a thermoset polyester material.

11. An improved electrostatic air cleaner cell as set forth in claim 9 wherein a portion of at best one of said side members is comprised of a carbon filler material.

* * * * *